United States Patent [19]

Molzan

[11] Patent Number: 4,465,189

[45] Date of Patent: Aug. 14, 1984

[54] WATERPROOF CONTAINER

[75] Inventor: Albert R. Molzan, Alhambra, Calif.

[73] Assignee: American Safety Flight Systems, Inc., Glendale, Calif.

[21] Appl. No.: 483,581

[22] Filed: Apr. 11, 1983

[51] Int. Cl.[3] ..... B65D 81/18; B65D 51/16

[52] U.S. Cl. ..... 206/524.8; 206/811; 215/262; 220/231

[58] Field of Search ..... 206/524.8, 811; 220/231, 4 B; 215/262

[56] References Cited

U.S. PATENT DOCUMENTS

| | | | |
|---|---|---|---|
| 1,440,690 | 1/1923 | Momosiman | 206/811 |
| 1,575,524 | 3/1926 | Benjamin et al. . | |
| 1,599,652 | 9/1926 | Cranston | 206/811 |
| 1,619,782 | 3/1927 | Archila | 206/811 |
| 1,631,371 | 6/1927 | Greubel | 206/811 |
| 1,720,170 | 7/1929 | Davies | 206/811 |
| 2,206,848 | 7/1940 | McAvoy | 206/811 |
| 2,220,407 | 11/1940 | Joss | 206/443 |
| 2,339,876 | 1/1944 | Phillips | 220/4 B |
| 2,695,207 | 11/1954 | Windsor | 312/31 |
| 3,072,285 | 1/1963 | Aileo | 220/4 |
| 3,133,664 | 5/1964 | Koch | 220/231 |
| 3,181,726 | 5/1965 | Parker | 220/4 B |
| 3,759,414 | 9/1973 | Beard | 220/231 |
| 3,797,694 | 3/1974 | See et al. . | |
| 4,051,971 | 10/1977 | Saleri et al. | 215/262 |

*Primary Examiner*—William T. Dixson, Jr.

*Attorney, Agent, or Firm*—Poms, Smith, Lande & Rose

[57] ABSTRACT

A self-venting waterproof container includes upper and lower waterproof body portions along with a sealing mechanism to effect a seal therebetween. A pressure relief valve provides venting communication between the interior of the container and the environment in which the container is used when there is a differential in environmental pressure and the pressure in the interior of the container. A vacuum relief valve eliminates, when opened, any vacuum existing in the interior of the container. Deformable material used for the body portions allows the container to collapse around the equipment therein under environmental pressure.

15 Claims, 4 Drawing Figures

Fig. 1.
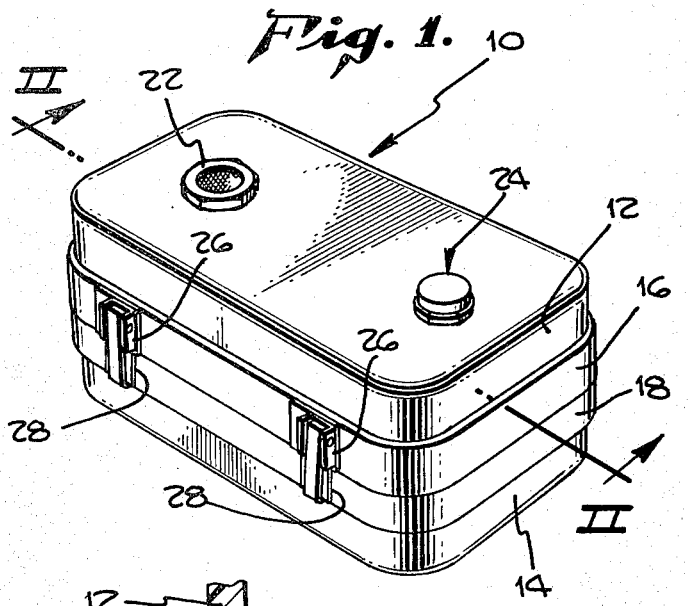
Fig. 4.
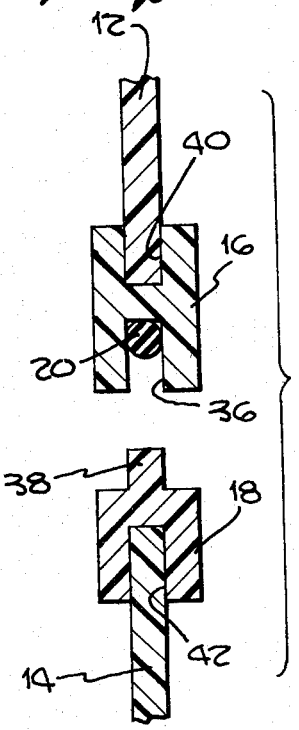
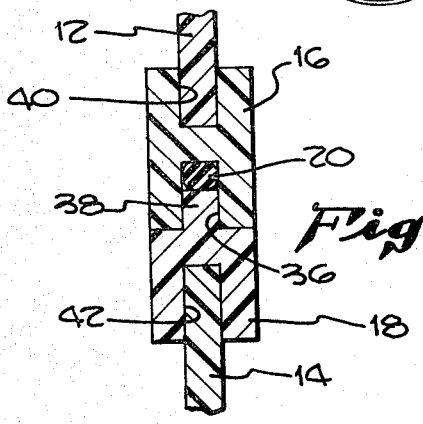
Fig. 3.
Fig. 2.
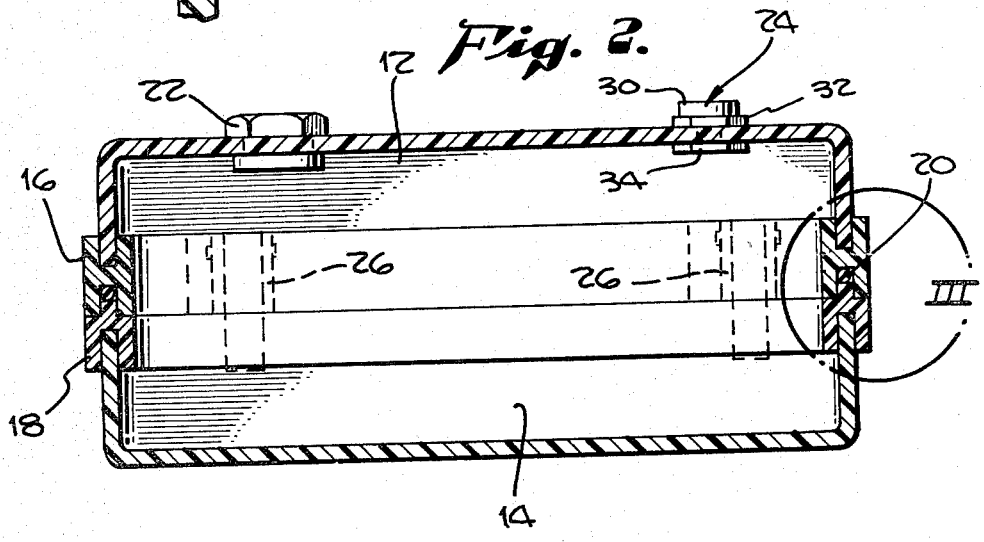

WATERPROOF CONTAINER

FIELD OF THE INVENTION

The present invention relates generally to waterproof containers and, more particularly, to containers usable over a wide range of environmental conditions.

BACKGROUND OF THE INVENTION

Waterproof equipment bags have been used by special military units for many years to protect equipment, particularly when the equipment is to be submerged or otherwise exposed to moisture. Equipment such as rifles, radios, optical and demolition equipment is typically protected by such bags.

These prior art bags, which typically comprise a zippered pouch of waterproof material, often leak and subject the equipment therein to damage. Furthermore, such bags, even when not leaking, are often inadequate to protect the equipment when the bag is subjected to significant depths, e.g., one hundred feet, as the bags have no means of relieving the external pressure applied to the bags and therefore burst.

Additionally, the waterproof bags which are used by the military in marine operations are often inadequate for use at high altitudes, as they have no means of equalizing pressure on the inside and outside of the bags as the atmospheric pressure decreases. This deficiency can also lead to bursting of the bags.

A waterproof container which includes a provision for venting the pressure in the interior of the container in response to external pressure would find great utility for not only military applications, but also for commercial and sporting applications such as protecting camera equipment. It also would be desirable in any such container to have the container collapse around the equipment in the container under the force of external pressure and to eliminate any vacuum established by such collapsing prior to the opening of the container.

Accordingly, it is the principal object of the present invention to completely and effectively seal equipment containers against water and moisture.

It is another object of the present invention to vent the interior pressure of the container out of the container in response to changes in environmental pressure.

Yet another object is to eliminate any vacuum established in the container after the air in the interior thereof has been discharged.

SUMMARY OF THE INVENTION

The present invention, in a broad aspect, provides a self-venting waterproof container. The container includes upper and lower waterproof body portions. A seal arrangement effects a seal between the body portions. A latch attaches the body portions together. A pressure relief valve discharges pressure within the container when there is a differential in the pressure of the environment surrounding the container and the interior of the container. A vacuum relief valve eliminates, when opened, any vacuum which has been established within the container.

The upper and lower body portions can be made of collapsible waterproof material. The sealing apparatus can include rigid rims attached to the edges of the upper and lower body portions with the second rim adapted to engage the first rim, and with an elastic gasket disposed between the two rims. A plurality of toggle latches about the periphery of the rims can draw the body portions together to allow the sealing mechanism to effect a seal between the body portions. The pressure relief valve can be an automatic valve, and the vacuum relief valve can be a manually operable valve.

Other objects, features, and advantages of the present invention will become apparent from a consideration of the following detailed description and from the accompanying drawings.

BRIEF DESCRIPTION OF THE DRAWINGS

FIG. 1 is a perspective view of a self-venting waterproof container according to the present invention;

FIG. 2 is a cross-sectional view of the invention of FIG. 1, taken through the plane II—II;

FIG. 3 is a detailed cross-sectional view of the mating surfaces of the container of the present invention, when the container is assembled, taken through the plane III—III of FIG. 2; and FIG. 4 is a view similar to FIG. 3 showing the mating surfaces when the container is disassembled.

DETAILED DESCRIPTION

Referring more particularly to the drawings, FIG. 1 shows a perspective view of a self-venting waterproof container 10 according to the present invention. The container 10 includes an upper body portion 12 and a lower body portion 14. These body portions may be of rubberized fabric material, molded rubber, or any other waterproof material. As contemplated by this invention, the material of which the upper and lower body portions 12 and 14 is constructed is a collapsible waterproof fabric. Furthermore, these upper and lower body portions 12 and 14 can be made in a wide range of sizes and shapes to protect a wide range of equipment such as rifles, radios, optical, and demolition equipment. The rectangular shape shown in the figures is for purposes of illustration only.

A seal is effected between the upper body portion 12 and the lower body portion 14 by rims 16 and 18 into which the body portions 12 and 14 are respectively bonded. As shown in FIGS. 2–4, the peripheral edge of the upper body portion 12 is bonded into a groove 40 on the rim 16. Likewise, the peripheral edge of the lower body portion 14 is bonded into a groove 42 on the lower rim 18. The bonding may be done by a variety of means known in the art such as gluing.

Each of the rims 16 and 18 is of a rigid material such as extended aluminum of rigid plastic and encircles the peripheral edges of the upper and lower body portions. Additionally, the upper rim 16 is provided with a channel 36 which is adapted to engage a flange 38 projecting upwardly from the lower rim 18. The channel 36 also has positioned therein an elastic gasket 20, which can be an o-ring. Accordingly, when the container is assembled, the flange 38 enters the channel 36 and bears against the gasket 20, thereby effecting a waterproof seal between the upper and lower body portions 12 and 14.

The upper body portion 12 is attached to the lower body portion 14 through the provision of a plurality of latches 26 which are attached to the upper rim 16 for engagement with the lower rim 18. As shown in the figures, four such latches 26 are used, two on each side of the container. The latches 26 shown in the figures are of the "toggle" variety and engage the edge of the lower rim 14. Reinforcing elements 28 are attached to the rim 14 to strengthen it in the areas where the attachment is to be made. While toggle latches have been shown in the figures and while the latches have been shown attached to the upper rim 16, it is to be understood that this arrangement is for purposes of illustration only and that other types of latches attaching the upper body portion 12 to the lower body portion 14 (or vice-versa) are within the scope of the present invention.

As particularly contemplated by the present invention, the container 10 includes a pressure relief valve 22 and a vacuum relief valve 24. The pressure relief valve 22 may be any conventional pressure valve as known in the art and in a prototype of the invention, a Halkey-Roberts Corp. Model 780-RPA-0.2 valve was used. The primary requirement of the valve 22 is that it only allows air to flow from within the bag to the environment surrounding the bag. The pressure valve 22 is positioned so as to communicate between the interior of the container and the environment surrounding the container. The pressure valve 22 is used to relieve the pressure in the interior of the container which will occur whenever a pressure differential exists across the container 10. Thus, for example, when the container is submerged and the bag is made of a collapsible waterproof fabric, the water pressure will increase on the device as it is brought deeper. As a result, the container 10 will collapse around the equipment stored therein and the air in the interior of the container 10 will be forced out of the container through the pressure relief valve 22 under the force of the water.

Conversely, if the container is brought high into the atmosphere such that the ambient pressure inside of the container exceeds that of the outside environment, the pressure relief valve 22 will allow air to escape from the interior of the container until a pressure equilibrium is obtained between the air within the container and the environment surrounding the container. As is apparent from the foregoing, the pressure relief valve 22 functions automatically to eliminate pressure differentials across the container 10.

Working in conjunction with the pressure relief valve 22 is the vacuum relief valve 24. As shown more particularly in FIG. 2, the valve 24 is a manual valve which comprises a screw 30 threadingly engaging a pair of nuts 32 and 34 on opposite sides of the upper body portion 12. This particular positioning of the vacuum relief valve 24 is for purposes of illustration only as the valve 24 will operate effectively regardless of where positioned on the container 10.

The purpose of the valve 24 is to eliminate the vacuum created within the container 10 after it has been collapsed under the force of external pressure. For example, after the container 10 is submerged and the force of the water on the container forces the air in the interior of the container out of the container through the pressure valve 22, a near-vacuum exists in the interior of the container 10. As a result, it would be quite difficult to disassemble the upper body portion 12 from the lower body portion 14 even after the latches 26 have been released as the vacuum would pull the upper and lower body portions 12 and 14 together. By unscrewing the screw 30 from the nuts 32 and 34, air is allowed to enter into the interior of the container 12 and thereby equalize the pressure between the interior of the container 10 and the atmosphere so as to allow easy disassembly of the container 10. It is to be understood that while a screw and nut arrangement has been shown, other means of relieving a vacuum created in the interior of the container 10 may be satisfactorily employed and fall within the scope of the present invention.

As seen from the foregoing, the present invention provides a simple and effective waterproof container which is responsive to changes in environmental pressure and which can be made in a variety of shapes for use with equipment of various shapes and sizes. It overcomes many of the deficiencies of the prior art and meets the stringent requirements of military use.

In the foregoing description of the present invention, a preferred embodiment of the invention has been disclosed. It is to be understood that other mechanical and design variations are within the scope of the present invention, some of which have been set forth above. Accordingly, the invention is not limited to the particular arrangement which has been illustrated and described in detail herein.

What is claimed is:

1. A ruggedized self-venting waterproof container adapted for military use over a wide range of environmental conditions, comprising:

an upper waterproof body portion adapted to hold military equipment;

a lower waterproof body portion adapted to hold military equipment;

sealing means for effecting a seal between said body portions;

pressure venting means for providing venting communication between the interior of said container and the environment in which said container is used when there is a differential in the pressure of said environment and the pressure in said interior; and vacuum relief means for eliminating, when open, any vacuum established in said interior, whereby said container may be alternatively subjected to both high altitude and deep submersion without leaking.

2. A container as defined in claim 1, wherein:

said body portions each comprise deformable material whereby said container may collapse under environmental pressure.

3. A container as defined in claim 2, wherein:

said waterproof material comprises molded rubber.

4. A container as defined in claim 2, wherein: p1 said waterproof material comprises rubberized fabric.

5. A container as defined in claim 1, wherein said sealing means comprises:

first rim means attached to said upper body portion, said first rim having a channel therein;

second rim means attached to said said lower body portion, said second rim means having a flange adapted to engage said channel; and gasket means disposed in said channel adjacent said flange whereby a waterproof seal is formed between said first and second rim means.

6. A container as defined in claim 5, wherein said first and second rim means each comprise an extruded aluminum member.

7. A container as defined in claim 5, wherein said first and second rim means each comprise a rigid plastic member.

8. A container as defined in claim 5, wherein said gasket means comprises an o-ring.

9. A container as defined in claim 1, wherein said pressure venting means comprises:

a pressure relief valve disposed to communicate between said interior of said container and said environment.

10. A container as defined in claim 1, wherein said vacuum relief means comprises:

manually operable valve means for establishing communication, when open, between said interior of said container and the atmosphere.

11. A container as defined in claim 1, wherein said container further comprises:

latch means for attaching said upper body portion to said lower body portion.

12. A container as defined in claim 11, wherein:

said latch means comprises a plurality of toggle switches disposed about the periphery of said upper body portion and adapted to engage said lower body portion, whereby said engagement draws said body portions together to allow said sealing means to effect a seal between said body portions.

13. A submersible, pressure-venting and rugged waterproof case adapted for military use over a wide range of environmental conditions, comprising:

a collapsible waterproof casing comprising a first casing half and a second casing half;

first flange means, attached to said first casing half;

second flange means, attached to said second casing half and adapted to engage said first casing half;

latch means, disposed on said first and second flange means, for attaching said first casing half and said second casing half; and automatic pressure relief valve means for relieving pressure from the interior of said case in response to changes in environmental pressure, whereby said casing may be subjected to both high altitude and deep submersion without leaking.

14. A case as defined in claim 13, wherein said case further comprises:

gasket means, disposed between said first and second flange means, for insuring a waterproof seal there between.

15. A case as defined in claim 13, wherein said case further comprises:

manually operable vacuum release means, for eliminating, when manually operated, any vacuum established in the interior of said case.

* * * * *

UNITED STATES PATENT AND TRADEMARK OFFICE

CERTIFICATE OF CORRECTION

PATENT NO. : 4,465,189

DATED : August 14, 1984

INVENTOR(S) : Albert R. Molzan

It is certified that error appears in the above-identified patent and that said Letters Patent are hereby corrected as shown below:

In column 2, line 49, the words "extended aluminum of" should read --extruded aluminum or--.

Signed and Sealed this

*Fifth* Day of *March 1985*

[SEAL]

*Attest:*

DONALD J. QUIGG

*Attesting Officer* *Acting Commissioner of Patents and Trademarks*